US005370400A

United States Patent [19]

Newton et al.

[11] Patent Number: 5,370,400

[45] Date of Patent: Dec. 6, 1994

[54] FLUID ENVIRONMENT SEALING SYSTEM

[76] Inventors: John R. Newton, 207 Elsa Rd., Jupiter, Fla. 33477; Jeffrey W. Strong, 485 Royal Palm Way, Boca Raton, Fla. 33432

[21] Appl. No.: 137,495

[22] Filed: Oct. 14, 1993

Related U.S. Application Data

[63] Continuation of Ser. No. 911,125, Jul. 9, 1992, abandoned.

[51] Int. Cl.[5] ..... F16J 15/00; B63H 5/06

[52] U.S. Cl. ..... 277/12; 277/68; 277/134; 277/152; 384/97; 440/112

[58] Field of Search ..... 277/12, 67, 68, 133, 277/134, 152; 384/97, 98, 138; 440/112

[56] References Cited

U.S. PATENT DOCUMENTS

| | | | |
|---|---|---|---|
| 1,733,416 | 10/1929 | Lebesnerois | 384/97 |
| 2,306,664 | 12/1942 | Paine | 384/97 |
| 2,981,573 | 4/1961 | Reuter | 384/138 |
| 3,072,447 | 1/1963 | Brown | 440/112 |
| 3,455,613 | 7/1969 | McGrath | 384/97 |
| 3,637,273 | 1/1972 | Orndorf | 384/97 |
| 3,724,919 | 4/1973 | Legally et al. | 384/97 |
| 3,863,737 | 2/1975 | Kakihara | 440/112 |
| 3,971,606 | 7/1976 | Nakano et al. | 384/97 |
| 3,975,026 | 8/1976 | Boyle et al. | 277/134 |
| 4,000,933 | 1/1977 | Derman et al. | 440/112 |
| 4,471,963 | 9/1984 | Airhart | 277/134 |
| 4,540,186 | 9/1985 | Beider | 277/188 R |
| 4,710,142 | 12/1987 | Lovell | 384/97 |
| 4,802,430 | 2/1989 | Kramer | 384/97 |
| 5,143,455 | 9/1992 | Squyres | 384/97 |

FOREIGN PATENT DOCUMENTS 0116951 5/1943 Australia .

*Primary Examiner*—William A. Cuchlinski, Jr.
*Assistant Examiner*—Daniel G. DePumpo
*Attorney, Agent, or Firm*—Michael Ebert

[57] ABSTRACT

A sealing system for effecting a seal around a rotatable cylindrical shaft. The system is intended to be employed with a shaft which extends through a wall, such as a boat hull, into an aqueous environment. The system employs an elastomeric seal which defines an aperture therewithin, and the seal is intended to be fitted around the rotatable shaft which it is intended to seal. Structure is provided to mount the seal at a location generally coaxial with the shaft and spaced from the wall on a side thereof opposite that of the fluid environment. Axially-extending grooves formed in a wall defining a continuous passage provided in, for example, a bearing/housing assembly which mounts the seal, can be employed to conduct fluid from the fluid environment to the location of the seal to effect lubrication and maintenance of the seal in a compliant state,

12 Claims, 2 Drawing Sheets

FLUID ENVIRONMENT SEALING SYSTEM

This is a continuation of application Ser. No. 07/911,125, filed on Jul. 9, 1992, now abandoned.

TECHNICAL FIELD

The present invention deals broadly with the sealing of a space against fluid leakage. More narrowly, however, the invention deals with sealing around a rotating structure, such as a cylindrical propeller drive shaft or rudder post in a boat, so that liquid outside the hull does not pass into spaces within the boa. Narrowly, the invention deals with a specific type of seal, structure for keeping it aligned on the rotating shaft, and a construction, in view of the nature of the material of which the seal is manufactured, for keeping the seal lubricated in order =o deter deterioration of the seal.

BACKGROUND OF THE INVENTION

Various applications exist wherein a rotating shaft extends, through a wall, into a fluid environment (and, more particularly, a liquid environment). In such applications, it is typically desirable, and even essential, that the side of the wall opposite that of the liquid environment be maintained in a dry state. That is, it is typically necessary that the wall be sealed against the passage of liquids therethrough, including occlusion around the rotating shaft or shafts.

One specific application which is illustrative of the problem is the sealing of a boat hull against passage of water in the external aqueous environment into spaces within the hull. It is, of course, necessary to preclude the leaking of water around the rudder post of a vessel, and this is true even in the case of a sailing vessel.

The problem is even more acute in the case of a power vessel. With such a boat, it is necessary to seal around not only the rudder post, but also around one or more rotating propeller drive shafts.

In the prior art, various types of resilient lip seals are used around propeller drive shafts. Typically in the prior art, they are placed in, or closely proximate, the hull flange shaft log assembly. At this location, in view of the fact that there is no bearing interface between the lip seal and the shaft, the seal can easily become misaligned. When this occurs, space, or at least a weaker seal, can occur on one side of the shaft as a result of the seal becoming displaced from an intended coaxial relationship with the shaft. When such displacement occurs, as one will be able to perceive, water can leak into the boat.

Another problem existing in the prior art is, in the case of some seals, providing adequate lubrication. Because of the resilient characteristics of the typical lip seal, it can be essential to adequate functioning and minimization of deteriorization of the seal that it be kept in a pliant state. The seal will, of course, be exposed to some water. In fact, it is the passage of the water that the seal is intended to inhibit, if not preclude. In the case of some materials, however, it is necessary that a high volume of water be provided to the seal to accomplish adequate lubrication. It is to these dictates and problems of the prior art that the present invention is directed. It is an improved sealing system which facilitates proper alignment of the seal on the rotating shaft and accomplishes adequate lubrication.

SUMMARY OF THE INVENTION

The present invention is a system for sealing around a rotatable, cylindrical shaft which extends generally coaxially through an aperture in a wall and into a fluid environment. The system includes an elastomeric seal member which defines an aperture therethrough. The aperture is provided with a diameter generally the same as the diameter of the shaft intended to pass therethrough. Means are provided for mounting the seal generally coaxially with the shaft. The mounting location is at a position relative to the wall wherein it is spaced from the wall on a side thereof opposite the fluid environment. The invention includes means for conducting fluid from the fluid environment along the shaft to effect adequate lubrication of the elastomeric seal.

In one embodiment of the invention, the seal can be mounted by means of a combination bearing/housing assembly. The bearing is provided at a location encircling the shaft and extending, at least in part, on a side of the wall opposite that of the fluid environment. The bearing has a first end which is maintained at a defined distance from the wall, and a second end. The housing for receiving the seal is integrally formed with the bearing at the second end thereof. The housing is provided with means to seat the elastomeric seal therewithin.

In the preferred embodiment, the integrally formed bearing and housing have a continuous, generally cylindrical passage formed therethrough. Such a passage functions to accommodate the shaft which is intended to be sealed. In the preferred embodiment, the passage can include a widened portion defined within the housing section. Such a widened portion of the passage defines a reservoir in which the elastomeric seal is disposed.

One construction of the seal includes a radially inward narrowing annular lip. When such a construction for the seal is utilized, the seal can be mounted within the housing so that the lip angles toward the wall, on one side of which is the fluid environment, as the lip extends radially inwardly. It is envisioned that the seal would be made of a material such as nitrile.

In the preferred embodiment, the means for conducting fluid from the fluid environment along the shaft to lubricate the seal can include one or more grooves formed in a wall defining the continuous, generally cylindrical passage. Such groove or grooves, it is intended, would extend from the first end of the bearing Lo the reservoir in order to conduct water into the reservoir.

When a bearing/housing assembly is so provided, and when a plurality of grooves are formed in the wall defining the passage, it is intended that all of the grooves extend from the first end of the bearing to the reservoir. The grooves would, typically, be circumferentially spaced from one another at substantially equal angles.

In one embodiment of the invention, the plural grooves could be made to spiral helically as they extend along the wall defining the passage through the bearing/housing assembly. An embodiment is envisioned wherein six grooves are provided and wherein each of the six grooves spirals substantially through 60 degrees as it extends along the wall surface. In such an embodiment, adjacent grooves could be spaced at equal angles from one another and extend fully about the 360 degrees of the passage. As will be able to be seen, in such an embodiment, a first end of one groove at the first end of the bearing would be axially aligned with the second end of an adjacent groove at the reservoir.

It is envisioned that the invention would have particular application to waterborne craft. The invention could function to seal the rudder post of a vessel and, if the vessel is a powered vessel, the propeller drive shaft or shafts which effect propulsion of the boat through the water.

The invention is thus an improved sealing system for sealing around a rotatable, cylindrical shaft which extends into a fluid environment. More specific features and advantages obtained in view of those features will become apparent with reference to the DETAILED DESCRIPTION OF THE INVENTION appended claims, and accompanying drawing figures.

DETAILED DESCRIPTION OF THE INVENTION

Figure 1:
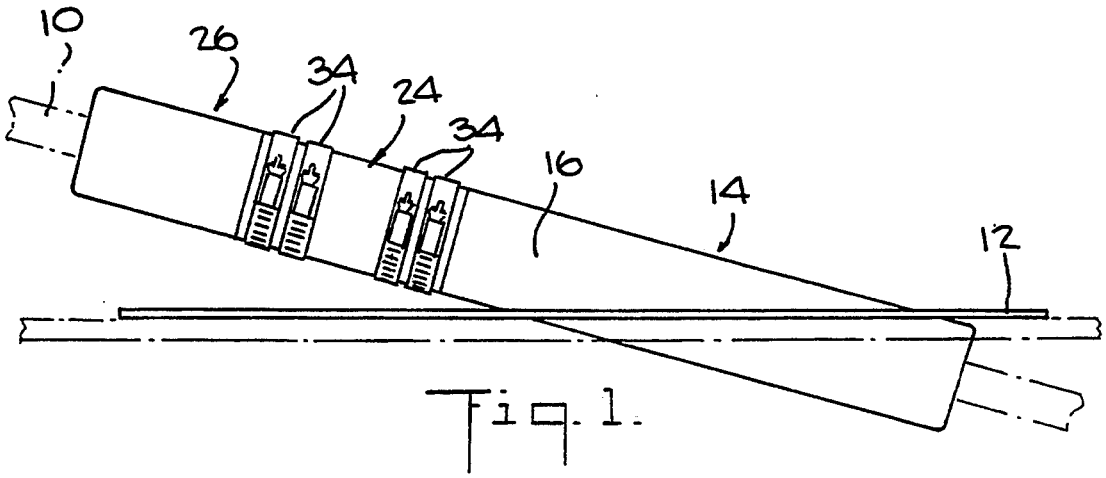
FIG. 1 is a side elevational view of an assembly including the present invention.

Referring now to the drawings wherein like reference numerals denote like elements throughout the several views, FIG. 1 illustrates the present invention as used in sealing around a propeller drive shaft 10 of a boat (not shown). The boat hull 12 is represented as having a hull flange shaft log assembly 14 fixedly mounted therewithin, and an aperture, central within that assembly 14 (that is, coaxial with respect to an outer cylindrical wall 16 defining the assembly 14), is provided to afford passage of the propeller drive shaft 10 therethrough.

Typically, the interface between the drive shaft 10 and an inner bearing surface of the hull flange shaft log assembly 14 is not water-tight. Consequently, water from the aqueous environment in which the boat operates can pass upwardly through the assembly 14 and into the interior of the boat unless means are provided to seal around the shaft 10. It is for this purpose that the present invention is provided.

Figure 2:
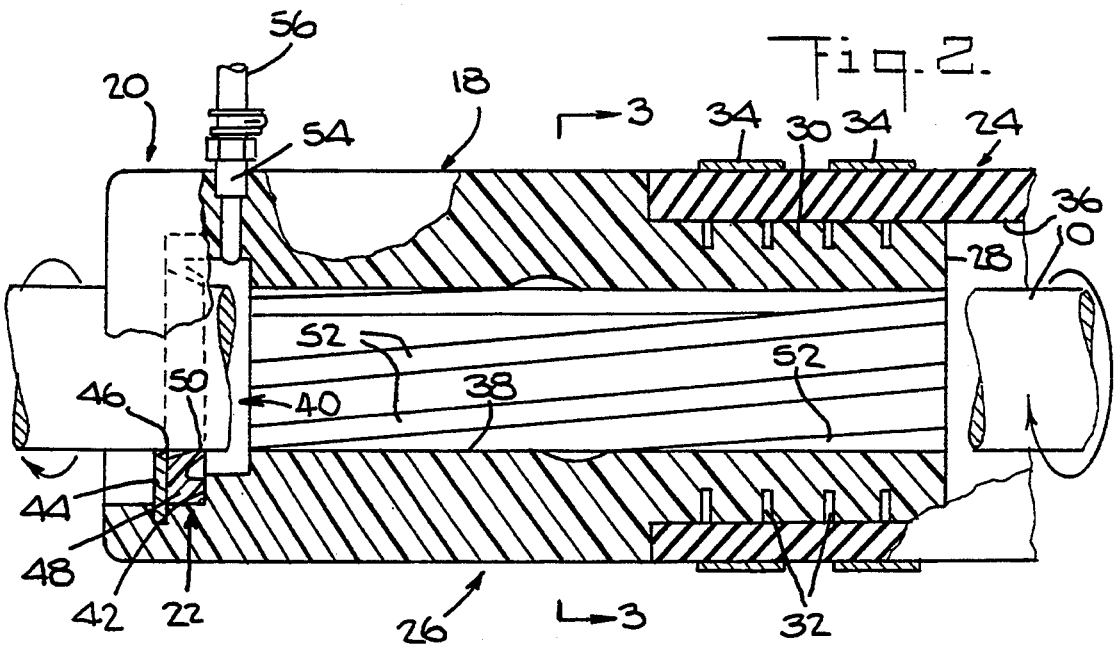
FIG. 2 is a fragmentary view of the invention, some portions thereof being cut away.

FIG. 2 illustrates in detail the present invention. The invention includes an integrally formed bearing 18 and housing 20 for receiving a seal 22 that will be discussed hereinafter. Bearing 18 and housing 20, it has been found, are appropriately made of an ultrahigh molecular weight polymer.

FIG. 1 illustrates, in its entirety, and FIG. 2 illustrates, in part, a resilient connector 24 which positions an assembly 26 of the bearing 18 and housing 20 at a defined location coaxial with respect to the aperture formed in the hull flange shaft log assembly 14 and spaced axially at a distance inboard of the boat hull 12. To this end 28, a first end of the bearing portion of the bearing/housing assembly 26 is provided with a nipple 30. The nipple 30 has an outside diameter which is substantially the same as an inside diameter of the resilient connector 24.

In like manner, the inboard end of the hull flange shaft log assembly 14 is also provided with a similar nipple (not shown) which is provided with an outside diameter substantially the same as the inside diameter of the resilient connector 24. The resilient connector 24 can, thereby, be fitted over the nipple at the inboard end of the hull flange shaft log assembly 14, and the bearing/housing assembly 26 in accordance with the present invention can be fitted into the opposite end of the connector 24.

FIG. 2 illustrates the bearing nipple as being provided with a series of axially-spaced, circumferentially-extending traction grooves 32. The grooves 32 illustrated in FIG. 2 are shown as being axially spaced at substantially equal distances. These traction grooves 32 function to effect a better retention between the connector 24 and the bearing/housing assembly 26 of the present invention.

In some embodiments of the invention, grooves 32 can be wider than as illustrated in FIG. 2. When such grooves 32 are provided, they can accept therewithin flat stainless steel rings (not shown). In these embodiments, the grooves 32 still serve to hold connector 24 against undesired withdrawal. Additionally, however, the rings function to prevent an installer from tightening hose clamps 34 to such an extent that they draw the material of the connector 24 down around the shaft 10.

It will be understood that it is also appropriate to provide such traction grooves in the nipple carried by the hull flange shaft log assembly. Typically, however, the hull flange shaft log assembly construction is "locked in" at the time of the manufacture of the vessel. Consequently, the nipple carried by the structure may or may not be provided with traction grooves such as at 32.

It will also be understood that FIGS. 1 and 2 illustrate one possible construction for effecting the mounting and disposition of the bearing/housing assembly 26 in accordance with the present invention to the hull flange shaft log assembly 14. While use of a resilient connector 24 made of rubber or other appropriate material intermediate the two assemblies is illustrated, other structures are specifically contemplated. Certainly, it is within the scope of the invention to mount the bearing/housing assembly 26 directly to the hull flange shaft log assembly 14 by appropriate means.

When a resilient connector member 24 is used intermediate the two assemblies 14, 26, hose clamps 34 can be employed to tightly secure respective ends of the connector member 24 to corresponding nipples. FIG. 1 illustrates a pair of hose clamps 34 as being used to secure each end of the connector 24 to its corresponding nipple. It will also be understood that, while hose clamps 34 are shown for tightening the connector ends onto the respective nipples, any appropriate tightening mechanisms may be employed.

As shown in FIG. 2, the resilient connector 24 is provided with a central passage 36 for accommodating the propeller drive shaft 10 which is sealed. FIG. 2 illustrates the connector 24 as having an inside diameter substantially larger than the outside diameter of the shaft 10. This dimensional relationship is not, however, exclusive.

The bearing/housing assembly 26 also has a continuous, generally cylindrical passage 38 extending axially therethrough. This passage 38 also functions to accommodate the propeller drive shaft 10. In the case of this passage 38, however, it has a diameter generally the same size as the outer diameter of the shaft 10, although there is not a seal along this portion of the shaft extension.

A reservoir 40, defined by a widening of the continuous, generally cylindrical passage through the bearing/housing assembly 26, is defined within the housing portion 20 of that assembly 26 proximate and end of the assembly 26 remote from the boat hull 12. An even greater widening of the passage 38 defines an axially-facing shoulder seat 42 against which seal 22, as defined hereinafter, is received. FIG. 2 shows a retainer ring 44, received within an annular groove 46, as engaging one axial face of the seal 22 to hold it in tight engagement against the axial shoulder seat 42 to maintain the seal 22 at an axial location within the passage 38.

The seal 22 illustrated in the drawings includes a main body portion 48 which has an outer diameter substantially the same as the widened portion of the passage 38 within which the seal 22 is received. Further, however, the seal 22 included a radially inwardly narrowing annular lip 50, the lip 50 angling toward the boat hull 12 as it extends radially inwardly.

An innermost annular tip of the lip 50 has a diameter slightly smaller than the diameter of the propeller drive shaft 10. The seal 22 is manufactured from an elastomeric material. It has been found that a material such as nitrile is particularly appropriate to serve the sealing function.

When a material as described above is used, the lip 50 can be formed wherein it is adequately thin so that it will be compliant to the shaft 10. The seal 22 is, of course, intended to be disposed in a position wherein the radially innermost annular tip of the seal lip 50 is coaxial with the shaft 10. As a result, the seal 22 will tend to not become separated from the shaft 10 at any location around its periphery. As jarring and bowing of the shaft 10, for example, occur, however, the compliance of the seal 22 and the normal tendency to maintain a positive seal will ensure continuation of the sealing function.

It is important to operation of the seal 22 that it be kept in a resilient state. It is necessary, therefore, that it be able to be lubricated at all times. Prior art structures have sought to effect lubrication only by providing an external source of fluid, such as water, oil, etc. to the location of the seal 22. The present invention, however, reduces the need for any special external source of lubricative fluid.

Figure 3:
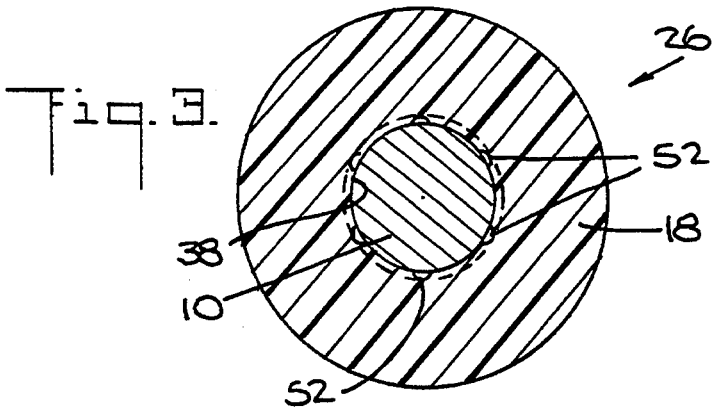
FIG. 3 is a sectional view taken generally along the line 3—3 of FIG. 2.

The present invention provides unique means for delivering water from the aqueous environment external to the boat hull 12 the reservoir 40 in which the sealing lip 50 of the seal member 22 is disposed. FIGS. 2 and 3 show a plurality of grooves 52 formed within a wall defining the passage 38 through the bearing/housing assembly 26. It will be understood that the invention specifically embraces an embodiment wherein a single groove 52 is provided. The preferred embodiment, however, does, in fact, employ a plurality of grooves 52.

FIGS. 2 and 3 show a structure wherein six axially-extending grooves 52 are employed. As seen in FIG. 3, the grooves 52 are formed in the wall defining the passage 38 and are spaced at equal angles about the periphery of the passage wall. Since the embodiment illustrated employs six grooves 52, one groove is spaced from adjacent grooves at 60 degrees.

FIG. 2 illustrates the grooves 52 extending fully from the first end 28 of the bearing 18 (that is, the end of the bearing 18 most closely proximate the hull flange shaft log assembly 14) to the reservoir 40 formed by a widening of the passage 38 within the housing portion 20 of the assembly 26. Consequently, any water having migrated upwardly through the hull flange shaft log assembly 14 and resilient connector 24 will be free to pass upwardly through the groove or grooves 52 into the reservoir 40 to keep the seal lip 50 lubricated.

It will, of course, be borne in mind that the water level as above the boat hull panel level illustrated in FIG. 1. This is so since, as the boat is launched, it will settle into the water until it displaces a volume of water which weighs the same as does the boat. The level of water within an assembly of the hull flange shaft log assembly 14, resilient connector 24, and bearing/housing assembly 26 will, therefore, be above the level of the boat hull panel. The embodiment of the present invention illustrated in FIGS. 2 and 3, however, employs means for more positively driving water into the grooves 52 and therealong so that water is more efficiently conveyed to the reservoir 40 for lubrication purposes. This is accomplished by forming the grooves 52 in a spiral fashion so that, as the propeller drive shaft 10 rotates, water proximate the first end 28 of the bearing 18 will be driven into the grooves 52 and upwardly toward the reservoir 40. Direction of spiraling is coordinated with the direction of shaft rotation when the boat is moving in a forward direction so that the effect will be to convey the water into the grooves 52 rather than urge it downwardly out of the grooves 52. As viewed in FIG. 3 then (that is, looking downwardly through the bearing/housing assembly 26 toward the hull flange shaft log assembly 14), grooves 52 spiral in a clockwise direction, and the direction of the rotation of the shaft 10 to effect forward movement of the boat is in a counter-clockwise direction.

The preferred embodiment envisions grooves 52 wherein each groove spirals through 60 degrees through its full length from its beginning of the first end 28 of the bearing 18 to its end at the reservoir 40. As a result, the beginning of one groove 52 is axially aligned with the end of an adjacent groove 52. This is so since six grooves 52 are provided and they are spaced at equal angles around the periphery of the wall defining the passage 38. With such a construction, the full 360 degrees of the shaft 10 will be, to some extent, lubricated by the water passing upwardly through the grooves 52. While the structure illustrated and discussed herein employs grooves 52 which spiral only through 60 degrees, it will be understood that other configurations are also contemplated.

FIG. 2 illustrates a fitting 54 which, if employed, can provide communication between the reservoir 40 in the bearing/housing assembly 26 and a fluid intake or discharge. Such a fitting 54 can be mated with a hose 56 leading to a discharge (not shown), and water having been introduced into the reservoir 40 can be permitted to exit through the fitting 54 and hose 56 to discharge. Better circulation of water and maximization of cooling and lubricating effects are, thereby, achieved.

Similarly, the fitting 54 can be mated with a hose from a water intake. When configuration is in this fashion, lubrication from an external source can, if desired, be employed to augment that provided through the grooves 52 formed in the wall defining the passage 38 through the bearing/housing assembly 26.

Figure 4:
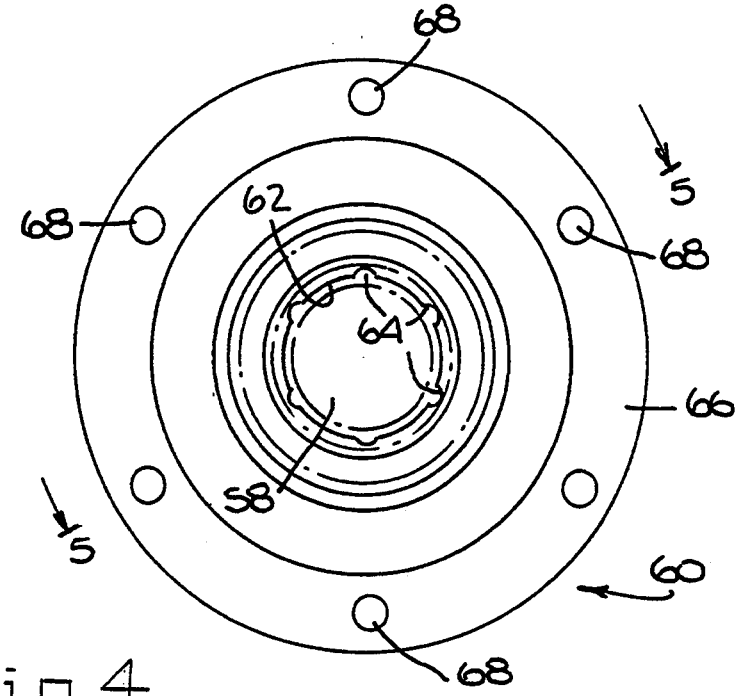
FIG. 4 is a top elevational view illustrating an alternative application of the present invention.
Figure 5:
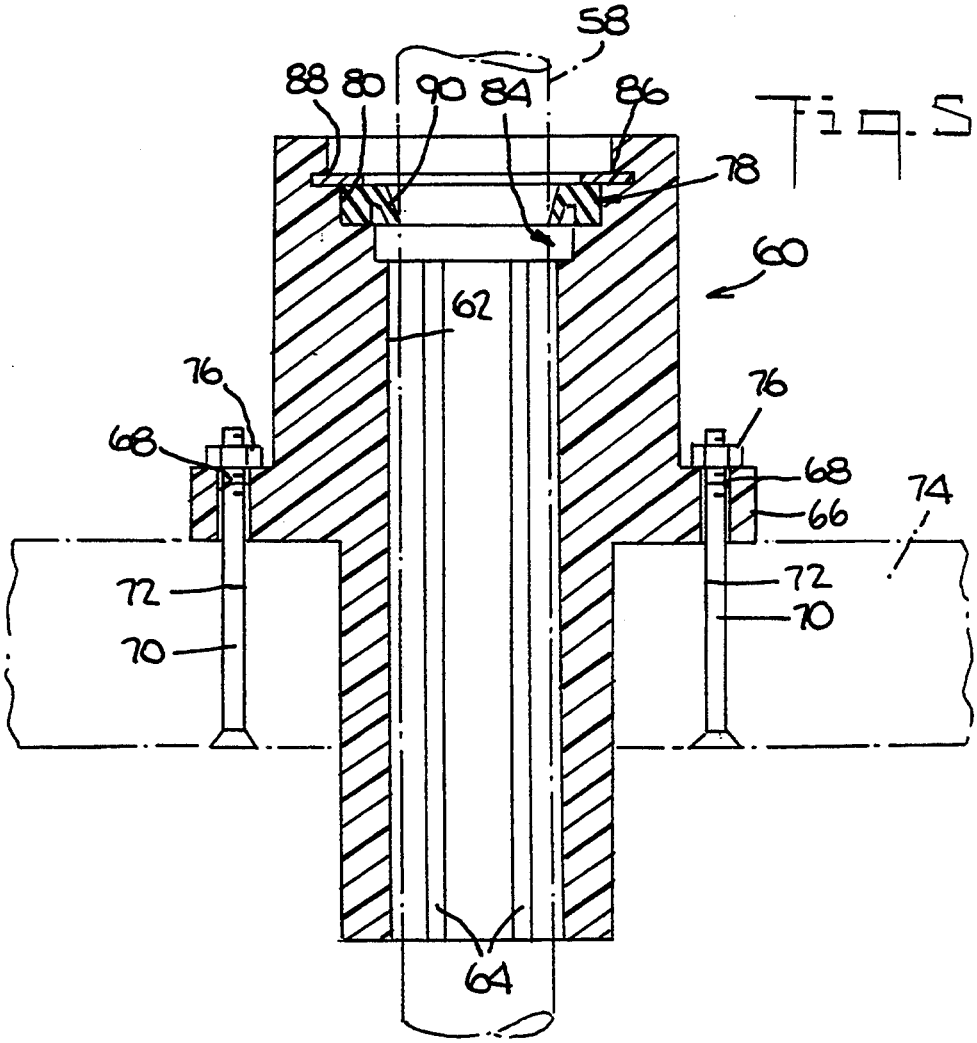
FIG. 5 is a sectional view of the structure shown in FIG. 4 taken generally along line 5—5 of FIG. 4, illustrating bolts and phantom lines to show connection of the structure to a boat hull.

FIGS. 4 and 5 illustrate an application of the present invention for use in mounting a rudder post 58 of a vessel. The construction of the bearing/housing assembly 60 illustrated in those figures is generally the same as that of the structure illustrated in FIGS. 2 and 3 with a number of exceptions. First, the orientation of the bearing/housing assembly 60 is such that the continuous, generally cylindrical passage 62 therethrough is oriented along a generally vertical axis. This is so since that is the typical orientation of the axis of a rudder post 58.

Second, while six equi-angularly grooves 64 are provided in the wall defining the passage 62, they are not shown as spiraling along the wall, and it would be unlikely that they would be so constructed in this application. While the rudder post shaft rotates as the rudder is turned, rotation is not in a uniform direction, and rotation is considerably slower than in the case of the propeller drive shaft. Consequently, the driving of water forcefully up the grooves 64 would not result even if a spiraling configuration were employed.

Finally, in view of the nature of the location and orientation of the structure in this application, the external surfaces of the bearing/housing assembly 60 are configured differently than those of the embodiment discussed hereinbefore. FIGS. 4 and 5 illustrate a bearing/housing assembly 60 wherein approximately the upper one-half of the length has a greater diameter than does the lower half. Further, a flange 66 is provided generally at the axial middle of the assembly 60. This flange 66 is provided with a plurality of angularly spaced bolt holes 68, and appropriate pins or bolts 70 are passed through these holes 68 and corresponding, registered holes 72 in the boat hull 74. Securing means, such as nuts 76, when bolts are used, effect secure mounting of the bearing/housing assembly 60 to the boat hull 74.

FIG. 5 does not show the fitting illustrated in the embodiment shown in FIGS. 2 and 3. It will be understood that, typically, such a fitting would not be used in this application. The invention does not, however, foreclose the employment of such structure even in this rudder post application.

In all other respects, the embodiment illustrated in FIGS. 4 and 5 is substantially identical to that illustrated in FIGS. 2 and 3. It will be understood that a seal member 78 is received within a widening 80 of the passage 82 above the reservoir 84 and maintained in position by the employment of a retainer ring 86 to be received within an annular groove 88. As in the case of the embodiment of FIGS. 2 and 3, the seal 78 would employ an annular lip 90 extending into the reservoir 84 so that lubrication of the seal lip 90 would occur. It is intended that the seal material that would be used in the embodiment of FIGS. 4 and 5 be the same as that in the embodiment of FIGS. 2 and 3.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A system installable in the hull of a boat for sealing around a rotatable, cylindrical propeller drive shaft which extends generally coaxially through an aperture in a hull flange shaft log assembly, passing through the boat hull into an aqueous environment in which the boat operates, said system comprising:

(a) a bearing formed of ultrahigh molecular weight polymer, attachable to the hull flange shaft log assembly at an inboard end thereof to encircle the shaft, said bearing having a first end, maintained at a fixed distance from the inboard end of the hull flange shaft log assembly, and a second end;

(b) a housing, integrally formed with said bearing at said second end of said bearing, said housing defining an annular reservoir within a radially inward surface thereof;

(c) a replaceable elastomeric seal coaxial with the shaft to allow passage of the propeller drive shaft therethrough, said elastomeric seal being positioned within said reservoir;

(d) means conducting water from the aqueous environment along the shaft, and for feeding said water into said reservoir in order to lubricate said elastomeric seal; and (e) means, in fluid communication with said means for conducting fluid from the fluid environment and located proximate said elastomeric seal, for discharging conducted fluid back to said aqueous environment whereby said fluid which lubricates and cools said elastomeric seal, continuously circulates.

2. Apparatus in accordance with claim 1 wherein said bearing and said housing have a continuous, generally cylindrical passage for accommodating the shaft extending therethrough, said passage widening within said housing to define a reservoir in which said elastomeric seal is disposed.

3. Apparatus in accordance with claim 2 wherein said elastomeric seal is annular, and wherein said seating means comprises an annular, axially-facing shoulder against which said annular elastomeric seal abuts and means for holding said seal engaged against said shoulder.

4. Apparatus in accordance with claim 3 wherein said holding means comprises a retainer ring received within an annular groove formed in a wall defining said passage.

5. Apparatus in accordance with claim 3 wherein said elastomeric seal includes a radially inward narrowing annular lip, and wherein said lip angles toward the wall as it extends radially inwardly.

6. Apparatus in accordance with claim 5 wherein said elastomeric seal is made of nitrile.

7. Apparatus in accordance with claim 2 wherein said conducting means comprises at least one groove formed in a wall of said continuous, generally cylindrical passage, said at least one groove extending from said first end of said bearing to said reservoir.

8. Apparatus in accordance with claim 7 wherein said conducting means comprises a plurality of grooves formed in said wall defining said continuous, generally cylindrical passage, said grooves extending from said first end of said bearing to said reservoir and being circumferentially spaced from one another at substantially equal angles.

9. Apparatus in accordance with claim 8 wherein said grooves spiral helically as they extend from said first end of said bearing to said reservoir.

10. Apparatus in accordance with claim 9 wherein there are six grooves formed in said wall defining said continuous, generally cylindrical passage, and wherein each groove spirals substantially through 60 degrees as it extends from said first end of said bearing to said reservoir, wherein a first end of one groove at said first end of said bearing is axially aligned with a second end of an adjacent groove at said reservoir.

11. A sealing system in accordance with claim 1 wherein said bearing and said housing have a continuous, generally cylindrical passage for accommodating the propeller drive shaft extending therethrough, and wherein said conducting means comprises a plurality of grooves, circumferentially spaced at generally equal angles from one another, extending axially from said first end of said bearing to said reservoir.

12. A sealing system in accordance with claim 11 wherein said grooves spiral helically so that, as said propeller drive shaft rotates, water from the aqueous environment will be driven along the shaft into said reservoir.

* * * * *